United States Patent [19]

Ambasz

[11] Patent Number: 4,777,572

[45] Date of Patent: Oct. 11, 1988

[54] FLASHLIGHT WITH ADJUSTABLE LAMP HOUSING

[76] Inventor: Emilio Ambasz, 295 Central Park West, New York, N.Y. 10024

[21] Appl. No.: 934,742

[22] Filed: Nov. 25, 1986

[51] Int. Cl.[4] ..... F21L 7/00

[52] U.S. Cl. ..... 362/197; 362/199; 362/206

[58] Field of Search ..... 362/157, 188, 194, 197, 362/199, 202, 205, 206, 427

[56] References Cited

U.S. PATENT DOCUMENTS

| | | | |
|---|---|---|---|
| 1,820,960 | 9/1931 | Champagne et al. | 362/197 |
| 1,832,563 | 11/1931 | Kuhn | 362/197 |
| 2,539,974 | 1/1951 | Riddell | 362/199 |
| 3,863,062 | 1/1975 | Caron | 362/197 |
| 4,129,899 | 12/1978 | Dunbar | 362/199 |

*Primary Examiner*—Samuel Scott
*Assistant Examiner*—Noah Kamen
*Attorney, Agent, or Firm*—Brumbaugh, Graves, Donohue & Raymond

[57] ABSTRACT

A flashlight comprises a battery housing component and a lamp housing component, both with peripheral walls of elliptical cylindrical shape having, respectively, the same major and minor diameters, and terminating at one end, respectively, in a circular edge that lies in a plane that is oblique to the axis of the cylindrical wall by a selected angle A and includes a major diametrical chord of the ellipse of the walls. The minor diameter of the ellipse of the peripheral walls of each component is equal to the cosine of the angle A times the major diameter. The housing components are joined together with their circular edges meeting for rotation of the lamp housing component on the battery housing component, thereby permitting adjustment of the direction of the light beam relative to the axis of the battery housing component.

4 Claims, 2 Drawing Sheets

FLASHLIGHT WITH ADJUSTABLE LAMP HOUSING

FIELD OF THE INVENTION

Battery-powered lamps, such as flashlights and lanterns, that have the capability of adjustment of the direction of the light beam, relative to the axis of a housing, are known. For example, flashlights having a bendable "gooseneck" arm through which wires run to a lamp at the end (analogous to the common gooseneck desk lamp) are currently marketed. Similarly, there are lanterns that have a pivoted lamp housing wired to a large battery.

In the fields of floor and table lamps for residential and office lighting, many arrangements for adjusting the direction of the beam for the light source are in common use. The present inventor has previously designed such lamps having lamp housings that rotate on a base or column. One such design is a table lamp having a circular cylindrical base and a circular cylindrical lamp holder, both of the same diameter, joined for rotation of the lamp holder about an axis perpendicular to a plane cutting the cylinders at an angle oblique to the cylinder axis and defining matching elliptical edges on both the base and lamp cylinders. When the lamp holder is rotated on the base to the position in which its axis is aligned with the axis of the base cylinder, the lamp, which is mounted in the top end of the lamp holder, beams up along the cylinder axis. In all other rotational positions of the lamp holder, the light beams along different angles oblique to the base cylinder axis. When the lamp holder is rotated 180 degrees from the axes-aligned configuration (straight up beam), the light is directed at an angle twice that of the cutting plane that demarks the juncture between the base and the lamp holder.

In the aligned and the 180 degrees-from-aligned positions the elliptical edges of the cylinders match. In all other positions of the lamp holder, the elliptical edges are out of register, leaving exposed portions of the meeting elliptical end walls of the cylinders. This lamp design has been effectuated in practice with stops to establish the aligned and the 180 degrees-from-aligned positions of the lamp holder to prevent excessive twisting of the electrical cord, which runs through the base to the lamp fixture in the holder.

The present inventor has also designed a floor lamp having a V-shaped bracket composed of two circular discs joined at an edge and oriented perpendicular to each other. One of the discs is rotatably mounted on a support column, and the lamp housing is rotatably mounted on the other disc. The support column and lamp housing are both elliptical cylinders of the same major and minor diameters, respectively, the diameters being in the ratio of the square root of one to one. The bracket is rotatable the lamp holder is rotatable through 180 degrees (also between stops) on the bracket to prevent the electrical cord for the lamp fixture from excessive twisting. The elliptical-cylindrical column and lamp housing have circular edges at their junctures with the discs of the bracket formed by cutting the cylinders along planes 45 degrees to their axes. The discs have a diameter equal to the major diameter of the column and lamp housing and thus have perimeters coincident with the circular edges of the column and lamp housing. The light from the floor lamp can be directed straight up, straight down or in any direction in between by rotating the bracket about the column and the lamp holder about the bracket. The floor lamp is disclosed in U.S. Design Patent Application Ser. No. 648,886, filed Sept. 10, 1984, by Emilio Ambasz and entitled "Floor Lamp."

SUMMARY OF THE INVENTION

There is provided, according to the present invention, a flashlight having a battery housing and a lamp housing, a lamp affixed within the lamp housing and means for forming an electrical circuit between at least one battery received in the battery housing and the lamp. The invention is characterized in that the battery and lamp housing are separate components, in that the components have peripheral walls of elliptical cylindrical shape having, respectively, the same major and minor diameters, and terminating at one end, respectively, in a circular edge that lies in a plane that is oblique to the axis of the cylindrical wall by a selected angle A and includes a major diametrical chord of the ellipse of the walls, and in that the minor diameter of the ellipse of the peripheral walls of each component is equal to the cosine of the angle A times the major diameter. The housing components are joined together with their circular edges meeting for rotation of the lamp housing component on the battery housing component about an axis perpendicular to the said plane and coincident with the geometric centers of the circular edges. The circuit-forming means includes a first conductive contact element affixed to the battery housing component proximate to the circular edge thereof and a second conductive contact element affixed to the lamp housing component and in continuous engagement with the first contact element throughout the range of rotation of the lamp housing component.

In one preferred embodiment, the first and second contact elements are annular rings that are adapted to engage each other along their circumferential extents in all rotational positions of the lamp housing component.

One or more of the following additional characteristics may be embodied in a flashlight, according to the present invention.

The circuit-forming means may include a third conductive contact element affixed to the battery housing component and positioned substantially at said plane and at the geometric center of the circular edge, and a generally spherical fourth electrical contact element is mounted on the lamp housing in electrically conductive relation to one contact of the lamp and the third contact element, whereby the spherical fourth contact element maintains an electrical connection between the lamp contact and the third contact element throughout the range of rotation of the lamp housing component.

The housing components may have annular end walls extending inwardly from the respective circular edges, one of which has a circular hole concentric to the circular edge and the other of which includes a flange that is received through the hole in circumferential sliding engagement, the flange having an outwardly extending lip engaging the underside of the end wall adjacent the hole.

One of the end walls may have an annular recess in its face and the aforementioned first and second contact elements can be annular rings that are received in the recess and are adapted to engage each other along their circumferential extents in all rotational positions of the lamp housing component. One ring is electrically connected to the other lamp contact and the other ring is adapted to be electrically connected to a terminal of a battery received in the battery housing.

In a flashlight embodying the present invention when the lamp housing is rotated to a position in which its axis is in alignment with the axis of the battery housing, the light beam from the lamp is likewise aligned with the axis of the battery housing. As the lamp housing is progressively rotated away from the aligned position, the light beam is directed progressively away from the battery housing axis until, at the 180 degrees-from-aligned position, the beam is directed at an angle equal to twice the angle A of the planes of the circular edges. Accordingly, the flashlight is very useful, because it can be placed on end or on its back on a floor, table or other surface and the lamp housing can be adjusted to direct the beam in a desired direction.

For a better understanding of the invention, reference may be made to the following description of an exemplary embodiment, taken in conjunction with the figures of the accompanying drawings.

DESCRIPTION OF THE PREFERRED EMBODIMENT

Figure 1:
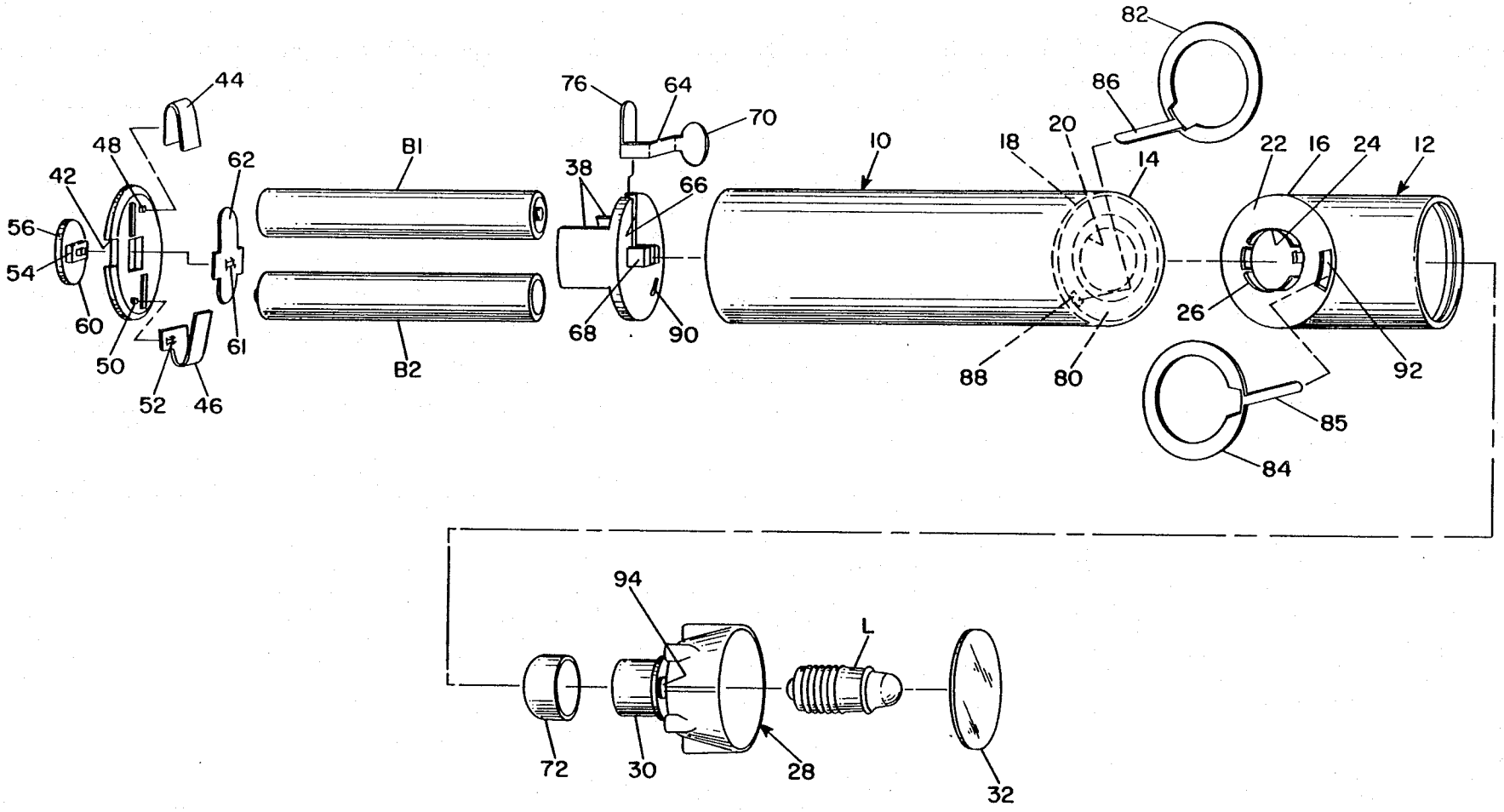
FIG. 1 is an exploded pictorial view of the embodiment.
Figure 2:
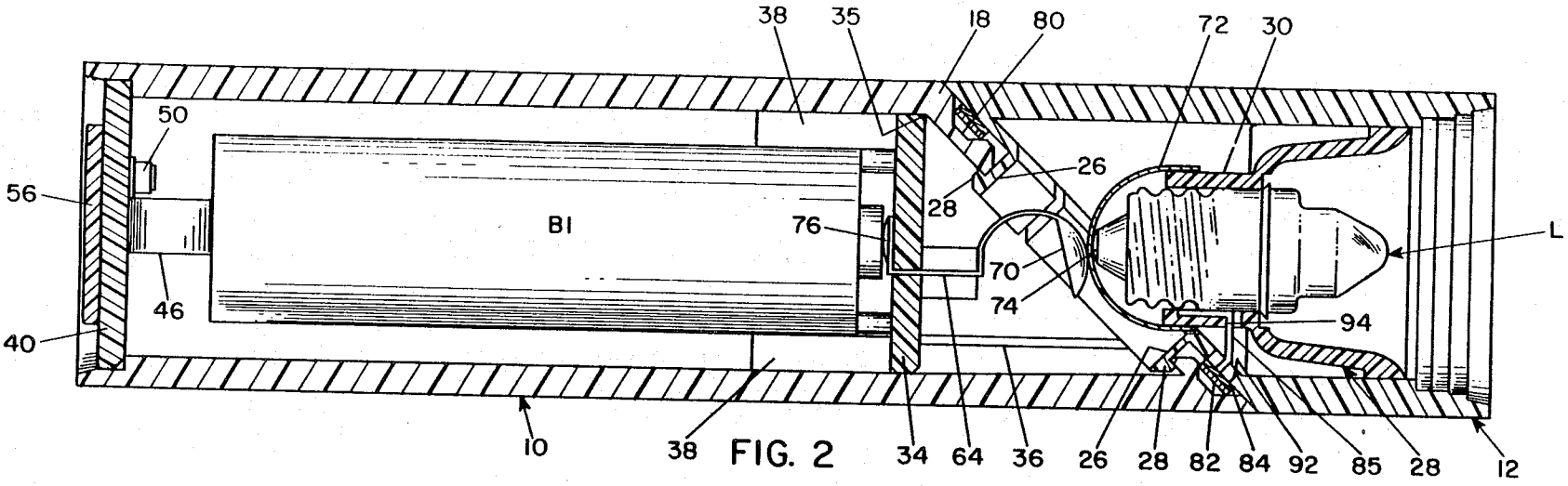
FIG. 2 is an axial cross-sectional view of the embodiment taken along the minor diameters of the housing components.

The embodiment comprises a battery housing component 10 and a lamp housing component 12, both of which are elliptical cylinders having the same major and minor diameters, respectively. One end 14, 16 of each housing component is defined by a circular edge that lies in a plane oriented at 45 degrees to the axis of the respective elliptical cylinder and includes a major diametrical chord of the ellipse of the cylinder. In order that the circular edge will be formed by the 45 degree plane, the ellipse of the cylinder must conform to the relationship, (minor diameter)=(major diameter)×(cosine 45 degrees). In the assembled flashlight the battery housing component and lamp housing component are joined together with the circular ends meeting in a manner that allows the lamp holder to be rotated about an axis perpendicular to the 45 degree planes of the ends 14, 16 and coincident with the geometric center of the circular edge. This arrangement allows the light beam to be directed at all angles between 0 degrees and 90 degrees, with respect to the axis of the battery housing component.

It is not required that the housing components have the geometry of the embodiment. For any non-circular elliptical cylinder, there is one plane oblique to the cylinder axis and includig a major diametrical chord that intersects the cylinder surface at a circle. If that plane lies at an angle A to the cylinder axis, the lamp housing component can be rotated on the battery housing component to direct the light beam at any angle between 0 degrees and twice the angle A. The angle A is preferred to be 45 degrees, because that provides the maximum range of adjustment of the light beam. Nonetheless, other angles for the circular edges of the components can be used with, of course, ellipses for the cylinders conforming to the relationship, (minor diameter)=(major diameter)×(cosine of the angle A).

Figure 3:
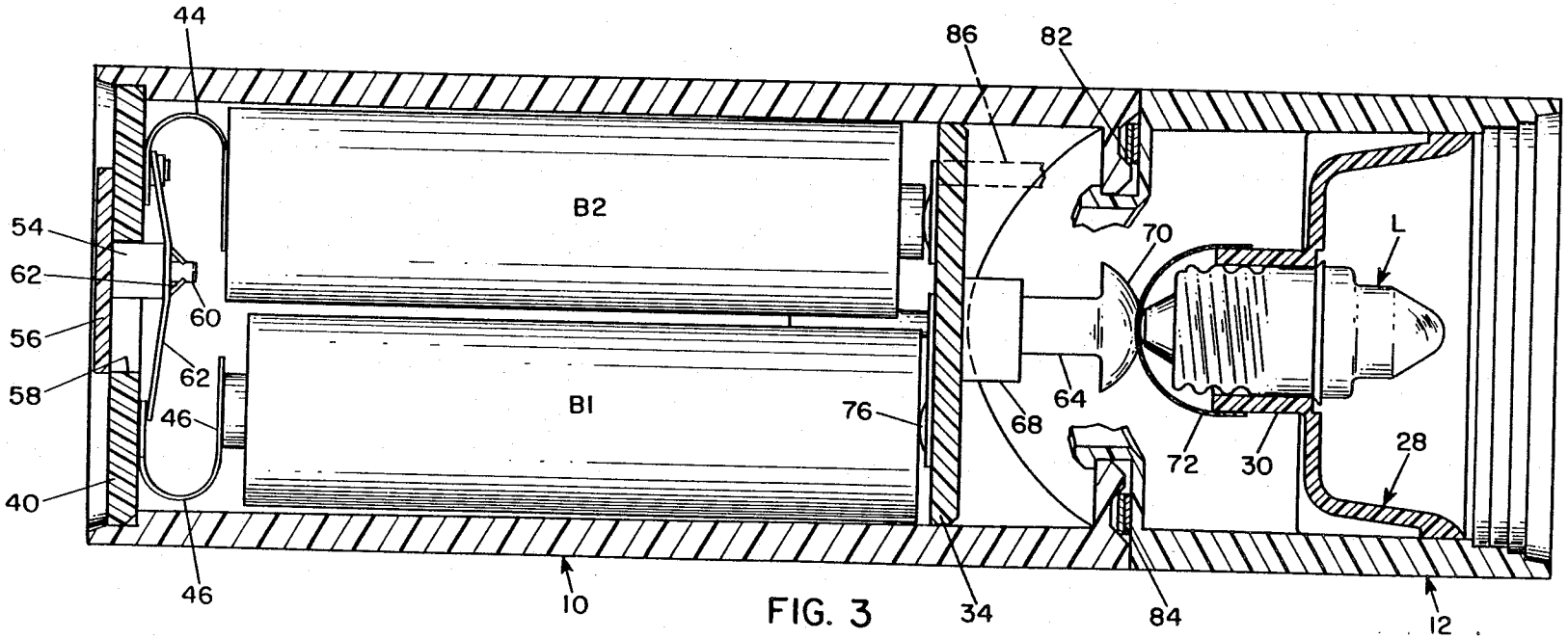
FIG. 3 is an axial cross-sectional view of the embodiment taken along the major diameters of the housing components.

In the embodiment the circular oblique end 14 of the battery housing component 10 has an annular wall portion 18 having a hole 20 concentric with the circular outer edge. Similarly, the end 16 of the component 12 has an annular wall portion 22 having a concentric hole 24. A series of flanges 26 extend out from the wall 22 at the edge of the hole 24 and are received in circumferentially sliding relation through the hole 20 in the wall 18 of the component 10. The flanges 26 have outwardly projecting lips 28 that underlie the wall 18 and retain the lamp housing component 12 on the battery housing component 10. The flanges 26 are resilient to enable assembly of the components 10 and 12 by mating the flanges 26 to the hole 20 and forcing the components 12 and 14 together, whereupon the component 12 snaps into place on the component 10 and is thereafter permanently retained by the lips 28. (In FIG. 3, the portions of the walls 18 and 22 behind the plane of the cross section have not been shown in order to simplify and clarify the drawing.)

The lamp housing component 12 receives a cup-like lamp holder 28 which has a receptacle portion 30 that acepts the base of a conventional flashlight lamp L. A lens 32 (see FIG. 1) fits into the open uppermost end of the component 12.

An upper battery support plate 34 is received in the upper portion of the battery housing component and is stopped in the proper axial position by the juncture 35 between the perimeter wall and end wall 18 and by ribs 36 molded into the inside of the perimeter wall. A pair of side flanges 38 extend down from the support plate 34 and stabilize the position of the plate against tilting and movement during assembly and when the batteries are removed for replacement. The bottom end of the battery housing is closed by an end cap 40 that snaps into place but can be removed for replacement of the batteries by inserting a screwdriver or similar tool into a notch 42 (see FIG. 1) at the edge and prying the closure out. Resilient electrical contacts 44 and 46 are mounted on the inside of the closure 40 by reception of small bosses 48 and 50 in holes (e.g., 52) with gripping tangs in the respective terminals. A post 54 on a switch button 56 extends slidably through a rectangular hole 58 in the end cap 40 and is attached by means of a boss 60 and a tanged hole 61 to a movable switch contact 62. In the position shown in FIG. 3, the switch is closed by bridging the contacts 44 and 46; when the switch button is moved from left to right (FIG. 3), the left portion o the switch contact 62 moves out of engagement with the terminal 44, thus opening the switch.

The battery support plate 34 receives a resilient electrical contact element 64 by sliding the contact 64 edgewise into a slot 66 until it is supported within a boss 68. At one end of the contact 64 is a disc portion 70 that in the assembled flashlight resides substantially at the geometric center of the circular end 16 of the battery housing component 10 and in the plane of the wall portion 20. In that position it is engaged by a spherical contact member 72 received on the lamp holder 28. The end terminal 74 on the lamp L, the contact member 72 and the disc portion 70 mutually engage in all rotational positons of the lamp housing, such engagement being ensured by a force generated by resilient deformation of the contact 64. At the other end of the contact 64 is a leg 76 that is bent out under the plate 34 and is engaged by the minus terminal of a battery B1.

The wall 18 of the battery housing component 10 has a shallow annular groove 80 that receives two electrical contact elements in the form of rings 82 and 84 of a conductive material. The contact ring 82 nearer the battery housing has a leg 86 that extends down through a slot 88 in the wall 18 and a slot 90 in the plate 34 and bends in to engage the negative terminal of the battery B2. The contact ring 84 has a leg 85 that extends up through a slot 92 in the wall 22 of the lamp housing component 12, turns in and passes through a slot 94 in the lamp socket 30 and turns down within the socket for engagement with the peripheral terminal of the lamp L. The face-to-face engagement of the contact rings 82 and 84 ensures maintenance of an electrical circuit connection at the juncture between the battery housing component and lamp housing component throughout the range of rotation of the lamp. It will be apparent that one of the rings could be replaced by a contact shoe; it is preferable, however, to use two rings to ensure conductive contact, lest there be a dead spot for one reason or another between the shoe and ring.

In summary, the circuit path of the embodiment is as follows: base terminal 74 of lamp L; spherical contact 72; contact element 64; plus terminal of battery B1; minus terminal of battery B1; contact 44; switch contact 62; contact 46; plus terminal of battery B2; minus terminal of battery B2; contact ring 82; contact ring 84; peripheral terminal of Lamp L.

I claim:

1. A flashlight having a battery housing component and a separate lamp housing component, a lamp affixed within the lamp housing component, at least two batteries received in the battery housing component, and conductive electrical circuit-forming elements received by the housing components to form an electrical circuit between the batteries and the lamp, the housing components being of a rigid polymeric material and having peripheral walls of elliptical cylindrical shape and of the same major and minor diameters, respectively, and terminating at one end, respectively, in a circular edge that lies in a plane that is oblique to the axis of the cylindrical wall by a selected angle A and includes a major diametrical chord of the ellipse of the walls, the minor diameter of the ellipse of the peripheral walls of each component being equal to the cosine of the angle A times the major diameter, and the housing components being joined together with their circular edges meeting for rotation of the lamp housing component on the battery housing component about an axis perpendicular to the said plane and coincident with the geometric centers of the circular edges, characterized in that the battery housing component contains two identical cylindrical batteries arranged side-by-side with one battery inverted relative to the other so that opposite electrical terminals of the batteries are disposed adjacent the respective ends of the battery housing component and in that said circuit-forming elements include a first conductive contact element affixed to the battery housing component proximate to the circular edge thereof and having a portion in electrical contact with the electrical terminal of one of the batteries, a second conductive contact element affixed to the lamp housing component and in continuous engagement with the first contact element throughout the range of rotation of the lamp housing component and having a portion in electrical contact with a terminal of the lamp, a third conductive contact element associated with the battery housing component and having a first portion positioned substantially at said plane and at the geometric center of the circular edge and a second portion in electrical contact with the electrical terminal of the other battery and a fourth electrical contact element mounted on the lamp housing in electrically conductive relation to one contact of the lamp and the third contact element, whereby the fourth contact element maintains an electrical connection between the lamp contact and the third contact element throughout the range of rotation of the lamp housing component, and in that a slide switch is mounted on an end wall of the battery housing component opposite and remote from the said one end, the switch including conductive contact elements arranged to make and break an electrical circuit between the battery terminals disposed adjacent said end wall, and an operating button fully recessed with respect to the end of the elliptical cylindrical walls of the battery housing component so that the flashlight can be placed upright on end.

2. A flashlight according to claim 1 and further characterized in that said first and second contact elements include annular ring portions that are adapted to engage each other along their circumferential extents in all rotational positions of the lamp housing component.

3. A flashlight according to claim 1 and further characterized in that the housing components have annular end walls extending inwardly from the respective circular edges, one of which has a circular hole concentric to the circular edge and the other of which includes a plurality of flanges received through the hole in circumferential sliding engagement, the flanges having outwardly extending lips engaging the underside of the end wall adjacent the hole.

4. A flashlight according to claim 3 and further characterized in that one of the end walls has an annular recess in its face and in that said first and second contact elements include annular ring portions that are received in the recess and are adapted to engage each other along their circumferential extents in all rotational positions of the lamp housing component.

* * * * *